US005971160A

United States Patent [19]

Abdulmassih et al.

[11] Patent Number: 5,971,160

[45] **Date of Patent: *Oct. 26, 1999**

[54] FIBRESAVER SCREEN BASKET SUPPORT

[75] Inventors: Antoine G. Abdulmassih, San Francisco, Calif.; Donald B. Johnson, Bedford, N.H.; Douglas L. G. Young, Nashua, N.H.; Brian J. Gallagher, Litchfield, N.H.

[73] Assignee: Ingersoll-Rand Company, Woodcliff Lake, N.J.

[ * ] Notice: This patent is subject to a terminal disclaimer.

[21] Appl. No.: 09/097,222

[22] Filed: Jun. 12, 1998

Related U.S. Application Data

[62] Division of application No. 08/412,796, Mar. 29, 1995, Pat. No. 5,823,355.

[51] Int. Cl.[6] ..... B07B 1/49

[52] U.S. Cl. ..... 209/405; 209/406; 209/409; 209/410; 209/412

[58] Field of Search ..... 209/399, 405, 209/406, 409, 410, 411, 412, 270, 273; 210/484, 485, 497.01, 497.1, 499, 495

[56] References Cited

U.S. PATENT DOCUMENTS

| | | | |
|---|---|---|---|
| 4,410,424 | 10/1983 | Chupka et al. | 209/393 X |
| 4,954,249 | 9/1990 | Gero et al. | 209/399 X |
| 5,011,065 | 4/1991 | Musselmann | 209/411 X |
| 5,094,360 | 3/1992 | Lange | 209/411 X |
| 5,118,421 | 6/1992 | Scarano . | |
| 5,472,095 | 12/1995 | Malm . | |
| 5,823,355 | 10/1998 | Abdulmassih et al. . | |

*Primary Examiner*—David H. Bollinger
*Attorney, Agent, or Firm*—Hill & Simpson

[57] ABSTRACT

A support structure for thin screenplates utilized for fine screens in Fibresaving applications for pulp fiber suspensions or the like wherein a support structure having a screen support in minimum screen contact positioned by a support reinforcement and positioning device, assembled to form an integral structure which reduces the stresses and deflections in the thin screenplates occurring in operation.

8 Claims, 2 Drawing Sheets

FIBRESAVER SCREEN BASKET SUPPORT

This is a divisional of application Ser. No. 08/412,796 filed on Mar. 29, 1995, now U.S. Pat. No. 5,823,355.

BACKGROUND OF THE INVENTION

The processing of pulp fibers requires several steps before the fibers can be used to manufacture paper. Some of these processes include pressing, washing and liquor extraction. These steps are performed by presses and washers that contain filtering surfaces with openings large enough for some fibers to pass through. The liquor, while flowing through the filtering surface therefore, carries with it a certain amount of fibers.

It is highly desirable to capture the fibers contained in the filtrate as they would otherwise represent loss of usable product and a source of disposal problems. In order to capture the fibers a filtering surface with openings small enough so that only the liquid can go through is required. This permits the collection of fibers. Such a machine is referred to by the present assignee as a Fibresaver Screen. There is a market demand for a screen with openings of 0.004" in diameter, or even smaller. The filtrate of the other machines described above would be fed into this machine in order to recover as many fibers as possible. Typically such a screen may be formed into the shape of a basket or hollow cylinder. Due to the manufacturing process and the economics of manufacturing a screen basket with very small openings the basket thickness cannot exceed a certain value. Usually the smaller the opening, the thinner the basket. For example, a basket with 0.1 millimeter (0.004" ) holes would have a thickness of no more than 1 millimeter (0.04" ). In a production machine of any size a screen basket of this thickness requires a supporting structure in order to handle the loads acting on it without failing.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

Our initial objective was to remove individual fibers from process liquor efficiently and cost effectively. This required the use of conventional pressure screens using cylindrical screenplates having very small holes. These small holes are cut by an electron beam or equivalent method and for this method of manufacture the plate must be much thinner than is desirable for strength. The holes are closely spaced to maximize capacity which results in very narrow ligaments between holes. Thus the screenplate has low strength, and for typical operating conditions can sustain only a small span between supports. Typical conventional means of reinforcement obstruct flow area and significantly reduce throughput capacity.

All embodiments of the present invention satisfy the initial objective in providing a strong and rigid screen cylinder assembly having maximum unobstructed area. The most frequent use of this invention will likely be in outward flow screen cylinders as described herein; however, an inward flow screen cylinder may adapt the present invention.

In one aspect of the present invention the above is accomplished by providing a support structure for a screen basket having a screen comprising a thin screen; a screen support means having minimum screen contact area to permit maximum flow through the screen; and means for positioning and supporting the screen support means.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
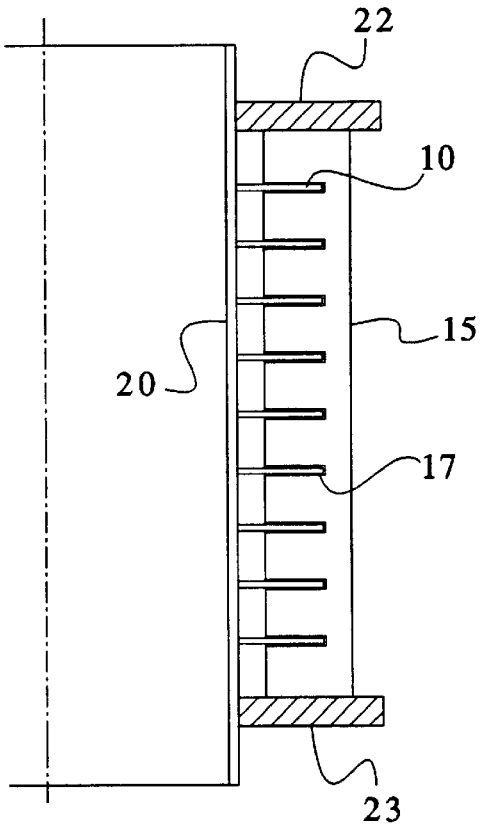
FIG. 1 is a partial longitudinal cross section of a screen basket according to the present invention showing the screen and a supporting structure according to the present invention.

According to the present invention a first proposed support structure for a vertically oriented screen basket is shown in FIG. 1. Please note the screen axis may be horizontal or vertical in use. In the orientation shown, a number of thin horizontal rings 10 are shown evenly spaced longitudinally about the screening basket 20. The screening basket 20 may, for example, be a cylindrical formed structure of screen material. For a Fibresaver Screen the thickness of the screen may be approximately 1 millimeter (0.04" ) being perforated with closely spaced holes of, for example, 0.1 millimeter (0.004" ) in diameter or even smaller. The rings 10 circumferentially support the screening basket. A number of vertical slotted-ribs 15 position and further support the horizontal rings. The rings and slotted ribs form a support structure in which the screening basket 20 is positioned. The vertical ribs contain slots 17 which are evenly spaced and into which the rings fit for easy assembly and control of the ring spacing. The ring thickness is maintained to a minimum and the vertical ribs are positioned so that they do not come in contact with the basket 20 in order to maximize the open area. The vertical ribs extend from a top mounting flange 22 to a bottom mounting flange 23 and are also further designed to withstand any vertical compression that the basket may be subjected to. Vertical precompression of the basket is sometimes necessary to prevent torsional vibration.

The top and bottom mounting flanges may also be used to mount the screening basket within the Fibresaver drum (not shown). In typical use the fiber containing liquor is introduced into the Fibresaver drum at the top and passes through the central portion of the screen to an outlet at the bottom of the drum. Liquid filtrate extracted from the liquor passes through the screening basket and generally exits a port in the side of the drum. The recovered fiber exits the bottom of the drum in the conventional manner well known to Fibresaver drum technology.

Figure 2:
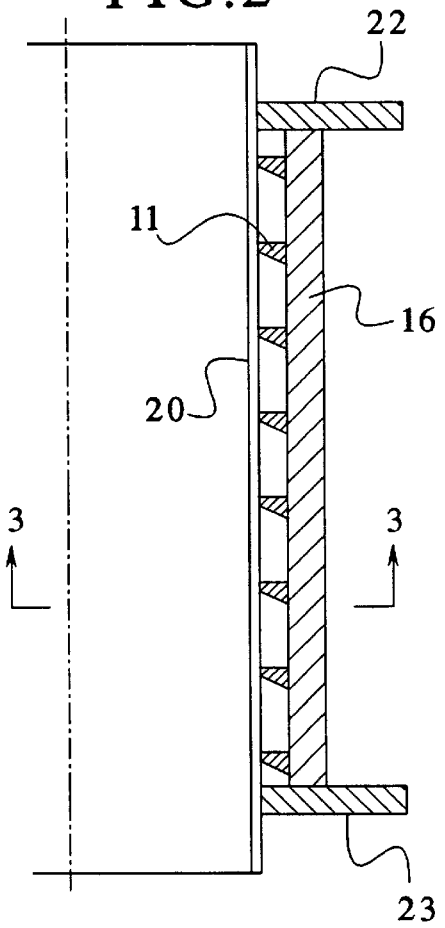
FIG. 2 is a partial longitudinal cross section of a screen and its supporting structure according to an alternative embodiment of the present invention.
Figure 3:
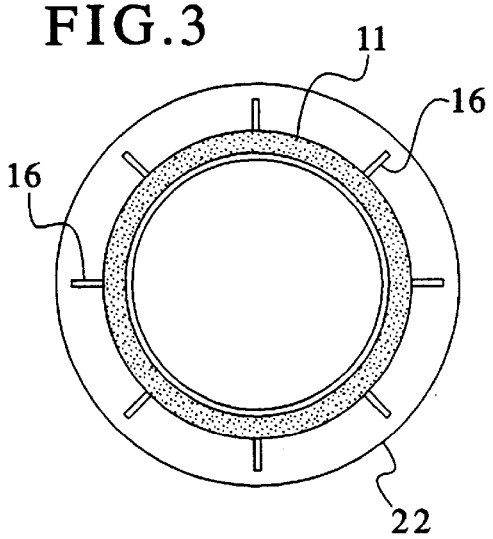
FIG. 3 is a cross section taken at Section 3—3 of FIG. 2.

FIG. 2 shows an alternate embodiment for the support structure wherein a rib 11 of substantially triangular cross section is spot welded to a vertical support rib 16 which in turn is disposed between a top and bottom flange 22, 23 respectively. FIG. 3 shows the cross section taken at Section 3—3 of FIG. 2 and shows a suggested radial spacing of the vertical ribs.

Figure 4:
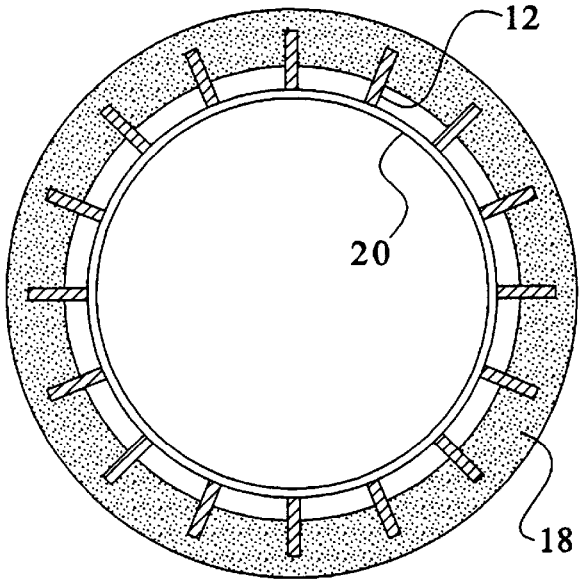
FIG. 4 is a cross section of a second alternative embodiment of the present invention.

FIG. 4 shows a second alternative embodiment wherein vertical ribs 12 are in contact with the screening basket 20. The vertical ribs of this embodiment are supported and evenly spaced by horizontal slotted rings.

Figure 5:
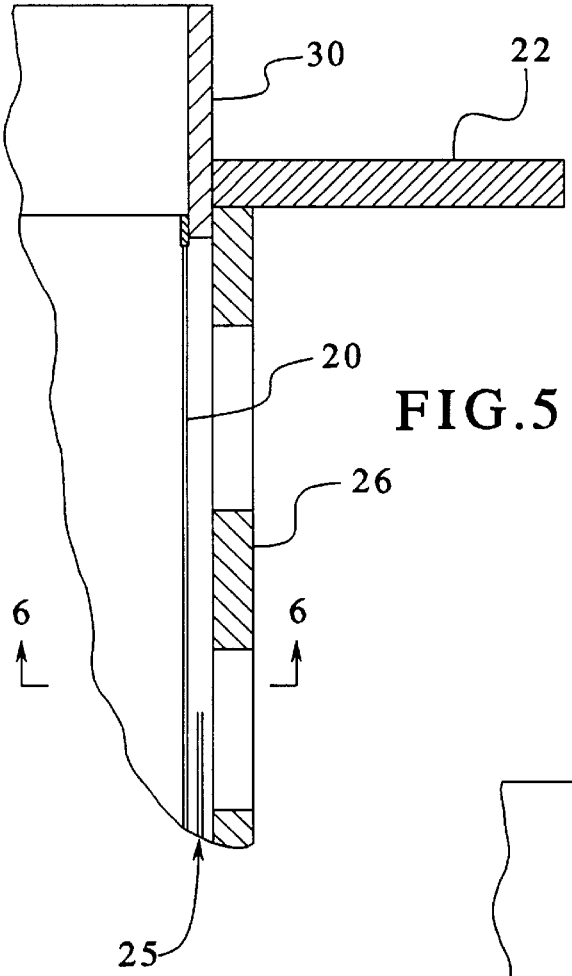
FIG. 5 is a partial longitudinal cross section of a third alternative embodiment of the present invention.
Figure 6:
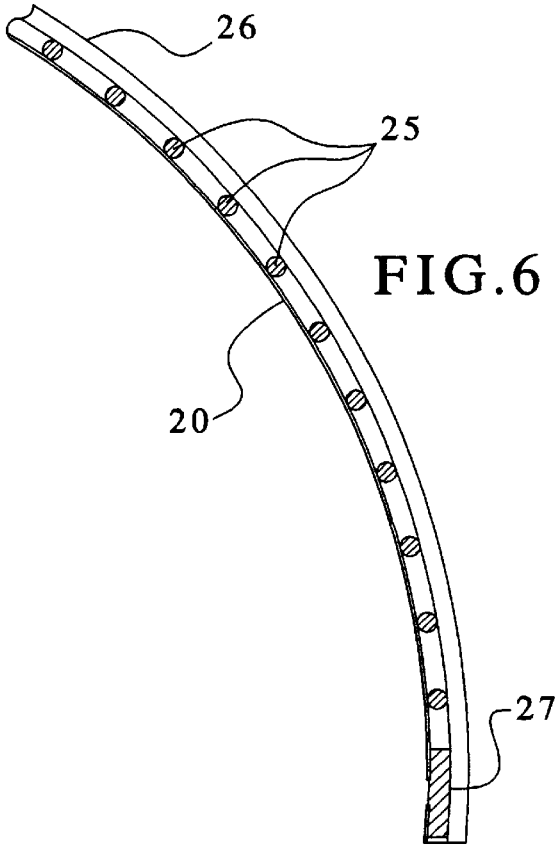
FIG. 6 is a partial cross section taken at Section 6—6 of FIG. 5.
Figure 7:
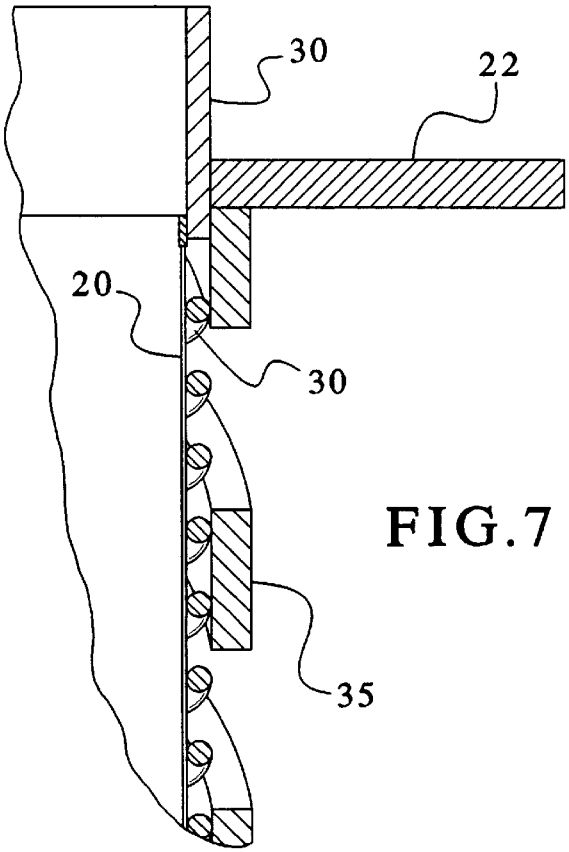
FIG. 7 is a partial longitudinal cross section of a fourth alternative embodiment of the present invention.

A third alternate embodiment is shown in FIGS. 5 and 6. In this configuration the thin perforated screenplate 20 is supported by a series of vertical support rods 25 which in turn are supported by a perforated cylindrical plate support frame 26. As shown in FIG. 5 the screen is attached at its end to a cylindrical spacer 30 for screen support. Vertical support rods 25 are suitably spaced and disposed within the external gap formed between the screen and the cylindrical support frame or plate 26. The support frame 26 may be constructed from a rolled cylindrical plate having relatively large holes or other shaped openings. These openings would be staggered so that they do not line up vertically. In construction the thin screening plate may be attached by electron beam or resistance welding or the like to the series of support rods. The screenplate 20 and rod 25 assembly can be rolled to the required curvature and assembled to the support frame 26 by means of attaching the rods to the support frame. To facilitate this a vertical strip 27 is provided to locate the screen. 15 FIG. 7 shows a fourth alternative embodiment wherein: the principle employed is that wire 30 is wound spirally around a cylindrical screenplate 20 such as to resist bursting (and/or buckling) forces in a radial direction. The pitch of the spiral being selected to suit the permissible unsupported span of the perforated plate. The outer strips 35 provide axial stiffness together with torsional stiffness in both directions to resist buckling and twisting.

The spirally reinforced assembly may be manufactured as follows: using a mandrel to ensure accurate dimensions the screenplate is formed into a cylinder around the mandrel and seam welded; then the top mounting flange 22 and bottom mounting ring (not shown) are weld assembled to the cylinder; next, the reinforcing wire may be wound spirally around the apertured length of the screen cylinder and attached by resistance welding; and finally the relatively wide and thin outer reinforcing strips 35, having been preformed to a spiral shape, are resistance welded to the spiral wires 30 at each crossing and welded to the mounting flanges. Note that a single or multiple start helix may be selected formed or wound to any desired pitch to accomplish the degree of stiffness, stability, and support required.

Compared to a conventional rolled and welded thick screenplate having machined fine slots, the overall radial thickness of the spirally reinforced assembly will not be significantly greater, and the radial dimensional accuracy of the screening surface will be significantly better. That is, it can be physically interchangeable with, and be more accurately made than, a conventional screen cylinder.

Additionally, all embodiments may make the practical use of other, novel thin screenplates. For example, a screenplate requiring very fine slots for the mainline screening of papermaking pulp can be made more precisely and cheaply from thin compared with conventional thick material. Further, for many applications thin screenplates may enable economical use of more wear resistant material which is expensive and/or difficult to manufacture from thick plate. Furthermore, for screening operations in which unconventional shape, orientation and/or pattern of apertures may be required, a thin screenplate permits economical machining by ECM and EDM techniques, and also facilitates economical three dimensional press forming when an irregular surface is required.

Having described our invention in terms of several embodiments above we do not wish to be limited in the scope of our invention except as claimed.

What is claimed is:

1. A combination screen basket and support structure for the screen basket comprising:

a thin cylindrical screen basket comprising a cylindrically formed structure of screen material perforated with closely spaced holes;

a pair of axially spaced mounting flanges;

a screen support in contact with and connected to an exterior of said screen, said screen support having a minimum screen contact area to permit maximum flow through said screen, said screen support extending from one to the other of said mounting flanges;

said screen support comprising a plurality of vertical ribs extending between the pair of mounting flanges and a plurality of axially spaced rings disposed between the screen basket and the vertical ribs, the vertical ribs extending between the mounting flanges to provide compression resistance.

2. A support structure for a screen basket according to claim 1 wherein:

said screen has closely spaced holes not more than about 0.004 inch in diameter.

3. A support structure for a screen basket according to claim 1 wherein:

said screen has a thickness of approximately 0.04 inch.

4. A combination screen basket and support structure for the screen basket comprising:

a thin cylindrical screen basket comprising a cylindrically formed structure of screen material perforated with closely spaced holes;

a pair of axially spaced mounting flanges;

a screen support in contact with and connected to an exterior of said screen, said screen support having a minimum screen contact area to permit maximum flow through said screen, said screen support extending from one to the other of said mounting flanges:

a pair of axially spaced cylindrical spacers disposed between the screen and the mounting flanges;

said screen support further comprises a plurality of vertical support rods disposed between the screen and a formed support plate having a plurality of openings, the formed support plate extending between the pair of mounting flanges to provide compression resistance.

5. A combination screen basket and support structure for the screen basket comprising:

a thin, cylindrical screen basket comprising a cylindrically formed structure of screen material perforated with closely spaced holes;

a screen support having a minimum screen contact area to permit maximum flow through said screen, wherein:

said screen support further comprises a plurality of vertical rods welded to an exterior said screen basket and a cylindrical support frame having a plurality of openings, said cylindrical support frame being welded to said rods, said rods being disposed between the screen and the cylindrical support frame.

6. A combination screen basket and support structure for the screen basket comprising:

a thin cylindrical screen basket comprising a cylindrically formed structure of screen material perforated with closely spaced holes;

a screen support having a minimum screen contact area to permit to permit maximum flow through said screen, wherein:

said screen support further comprises a spiral wound wire support coil that is attached to the screen and a spiral formed support strip that is attached to the support coil, the support coil being disposed between the screen and the support strip.

7. A method of manufacturing a support structure for a screen basket, wherein the support structure comprises:

a thin, cylindrical screen;

a screen support having minimum screen contact area to permit maximum flow through said screen wherein said screen support comprises a spiral wire wound support coil and a spiral formed support strip;

said method comprising:

using a mandrel to ensure accurate dimensions the screen is formed into a cylinder around the mandrel and seam welded;

a top mounting flange and bottom mounting flange are weld assembled to the cylinder;

said spiral wound wire is wound spirally around the apertured length of the screen cylinder and attached by resistance welding; and said support strip, having been preformed to a spiral shape, is resistance welded to said spiral wire at each crossing and welded to the mounting flanges.

8. A support structure for a screen basket having a screen comprising:

a thin cylindrical screen;

a pair of axially spaced mounting flanges;

a plurality of vertical ribs in contact with and supporting said screen, said plurality of ribs having minimum screen contact area to permit maximum flow through said screen, each of said plurality of ribs extending from one to the other of said mounting flanges to provide vertical compression resistance; and a plurality of slotted rings for positioning and supporting said plurality of vertical ribs.

* * * * *